US007150328B2

(12) United States Patent
Marketz et al.

(10) Patent No.: US 7,150,328 B2
(45) Date of Patent: Dec. 19, 2006

(54) METHOD FOR INTERCONNECTING ADJACENT EXPANDABLE PIPES

(75) Inventors: Franz Marketz, Rijswijk (NL); Robert Bruce Stewart, Rijswijk (NL)

(73) Assignee: Shell Oil Company, Houston, TX (US)

( * ) Notice: Subject to any disclaimer, the term of this patent is extended or adjusted under 35 U.S.C. 154(b) by 165 days.

(21) Appl. No.: 10/398,956

(22) PCT Filed: Oct. 11, 2001

(86) PCT No.: PCT/EP01/11820

§ 371 (c)(1),
(2), (4) Date: Apr. 30, 2003

(87) PCT Pub. No.: WO02/30611

PCT Pub. Date: Apr. 18, 2002

(65) Prior Publication Data

US 2004/0026089 A1 Feb. 12, 2004

(30) Foreign Application Priority Data

Oct. 13, 2000 (EP) ..... 00309016

(51) Int. Cl.
*E21B 19/16* (2006.01)
*B23K 26/00* (2006.01)

(52) U.S. Cl. ..... 166/380; 166/207; 219/121.64; 138/155

(58) Field of Classification Search ..... 219/121.64, 219/121.63, 59.1; 166/206, 207, 380, 384, 166/382, 379; 285/288.1, 328; 138/120, 138/155
See application file for complete search history.

(56) References Cited

U.S. PATENT DOCUMENTS

| | | | | |
|---|---|---|---|---|
| 4,978,834 | A | 12/1990 | Griffaton | |
| 5,789,720 | A * | 8/1998 | LaGally et al. | 219/121.64 |
| 5,954,374 | A * | 9/1999 | Gallagher et al. | 285/332 |
| 6,322,109 | B1 * | 11/2001 | Campbell et al. | 285/92 |
| 6,371,211 | B1 * | 4/2002 | Heijnen et al. | 166/378 |
| 6,607,220 | B1 * | 8/2003 | Sivley, IV | 285/334 |
| 6,745,846 | B1 * | 6/2004 | Innes et al. | 166/387 |
| 6,789,822 | B1 * | 9/2004 | Metcalfe | 285/333 |
| 2001/0002756 | A1 * | 6/2001 | Baerts et al. | 285/397 |
| 2002/0108756 | A1 * | 8/2002 | Harrall et al. | 166/382 |
| 2004/0074640 | A1 * | 4/2004 | Anderton et al. | 166/277 |
| 2004/0118569 | A1 * | 6/2004 | Brill et al. | 166/380 |
| 2004/0149450 | A1 * | 8/2004 | Harrall et al. | 166/380 |
| 2004/0173360 | A1 * | 9/2004 | Harrall et al. | 166/382 |

FOREIGN PATENT DOCUMENTS

| | | |
|---|---|---|
| FR | 2704166 | 10/1994 |
| RU | 2147664 C1 * | 4/2000 |
| WO | 93/25799 | 12/1993 |
| WO | 98/00626 | 1/1998 |
| WO | 98/22690 | 5/1998 |
| WO | 98/33619 | 8/1998 |
| WO | 98/42947 | 10/1998 |
| WO | 99/35368 | 7/1999 |

OTHER PUBLICATIONS

C.M. Banas, Laser Welding of Steels. OTC #4743. May 7, 1984. pp. 281-288.

* cited by examiner

*Primary Examiner*—David Bagnell
*Assistant Examiner*—Daniel P. Stephenson
(74) *Attorney, Agent, or Firm*—Rachael A. Stiegel

(57) ABSTRACT

The present invention relates to a method for interconnecting adjacent expandable pipes by Laser Beam Welding (LBW).

14 Claims, 4 Drawing Sheets

METHOD FOR INTERCONNECTING ADJACENT EXPANDABLE PIPES

FIELD OF THE INVENTION

The present invention relates to a method for interconnecting adjacent expandable pipes.

BACKGROUND OF THE INVENTION

International applications WO 93/25799 (which issued as U.S. Pat. No. 5,348,095), WO 98/00626 (which was filed as U.S. patent application Ser. No. 08/891,318) and WO 99/35368 (which was filed as U.S. patent application Ser. No. 09/223,996), the contents of which are incorporated by reference, concern the so-called 'expandable-tube technology' for well construction and wellbore repair. In short, this technology involves lowering a pipe (also referred to as 'oilfield tubular') of a malleable steel grade material into a borehole or existing casing, followed by an expansion process (e.g. by moving an expansion mandrel or pig through the pipe). The pipe may serve as a casing, or as a production tubing (liner) through which a hydrocarbon product is transported to the surface. Alternatively, the pipe may be expanded against the inner surface of a casing that is present in the borehole (e.g. as a protective cladding for protecting the well casing against corrosive well fluids and damage from tools that are lowered into the well during maintenance and work-over operations).

According to WO 93/25799 (which issued as U.S. Pat. No. 5,348,095), adjacent pipes may be joined using expandable threaded connections. For instance, a first casing may be provided with internal annular ribs having an inner diameter slightly larger than the outer diameter of a section of a second casing which extends into said section of the first casing. During expansion of the casing joint, the second casing is pressed against the ribs of the first casing, whereby a metal to metal seal is achieved between said section of the first and second casing.

International application WO 98/00626 (which was filed as U.S. patent application Ser. No. 08/891,318) describes a process for casing off the borehole of a gas or oil well which penetrates an underground formation. The method basically entails lowering a reeled pipe of a malleable steel grade into a borehole (which is created by conventional drilling methods), followed by an expansion process. International application WO 99/35368 (which was filed as U.S. patent application Ser. No. 09/223,996) is concerned with expandable tube technology for the production of slender wells and mono-diameter wells. According to this application casings are "bonded" and "sealed" by co-axial overlap between an expanded casing and an expandable casing followed by expansion of the latter. According to this application, it is preferred that the production tubing and at least one of the casings consists of a tubing which is inserted into the borehole by reeling the tubing from a reeling drum. Alternatively, the production tubing and/or at least one of the casings may be made up of a series of short pipes or pipe sections that are interconnected at the wellhead by screw joints, welding or bonding to form an elongate pipe of a substantially cylindrical shape that can be expanded and installed downhole in accordance with the method of that invention.

Expandable-tube technology therefore principally relies on lengthy pipes which are unreeled from a reeling drum into the borehole, or on short pipes that are equipped with treaded connections and that are interconnected on-site. However, either method has its drawbacks.

Good joint quality in (oil field) pipes is often essential or even critical as in gas wells. The welding technique typically employed is that of submerged arc welding (SAW), e.g., Tungsten Inert Gas welding (TIG welding). Pipes in the form of welded tubulars, wherein tubular elements are connected by TIG welding are for instance available from Well Engineering Partners B. V. (Holland) under the trademark "BIG LOOP". Unfortunately, safety requirements do not generally allow TIG welding at or near the borehole. Another form of welding, electrical resistance welding (ERW) is unacceptable for the same reason. Welding at the rig floor therefore seems to be too risky.

Other methods exist for interconnecting tubular elements, such as radial friction welding, and amorphous bonding, as in WO 98/33619, which cannot be used on the rig either (for safety reasons, but also for reproducibility and quality control reasons).

The advantage of threaded connections is that the pipe may be assembled tailor-made on the rig itself. On the other hand, threaded connections are not gas tight, especially when expanded, which may cause undesirable migration of reservoir fluids, even leading to gas migration and blow out. Besides, these connections of which a typical casing or production liner will contain many hundreds, form the weakest part of the pipe (having a tensile strength that is only 50–60% of that of the pipe itself).

A further drawback of these methods is that the pipes so produced may burst or rupture, at the connections or elsewhere in the pipe, when expanded. The reason for this is that the expansion behaviour at the connections differs from that elsewhere in the pipe. For instance, if an expansion mandrel is used to expand the pipe, then it may get stuck. Alternatively, the force required to expand the connection may be more than the pipe is capable of handling. It would therefore be beneficial to achieve a method for interconnecting pipes in a manner that does not effect the expandability of the pipe. Ideally, this method should be sufficiently safe and simple to allow the pipes to be assembled from tubular elements on a rig floor.

SUMMARY OF THE INVENTION

Now, in accordance with the present invention a method has been found that overcomes the drawbacks of the prior art methods. Accordingly, the invention provides a method for interconnecting adjacent expandable pipes characterized in that the pipes are circumferentially welded together by Laser Beam Welding (LBW). The invention also relates to the expandable and expanded pipes so prepared, both in the form of casing, cladding and production lines, and to a well provided with such pipes.

The expressions "pipe" and "pipes" as used in the text and claims of this application refer to tubular elements of various lengths and various wall thickness. For instance, relatively short pipe sections may be used of average length 6.7 m (API range 1) up to reeled pipes of 300 meter and longer. Likewise, the diameter may vary from 0.7 mm (e.g. used for cladding) up to 16 mm (typical diameters for production lines vary from 2.87 to 16.13 mm, whereas typical diameters for casings vary from 5.21 to 16.13 mm).

DETAILED DESCRIPTION OF THE INVENTION

Figure 1:
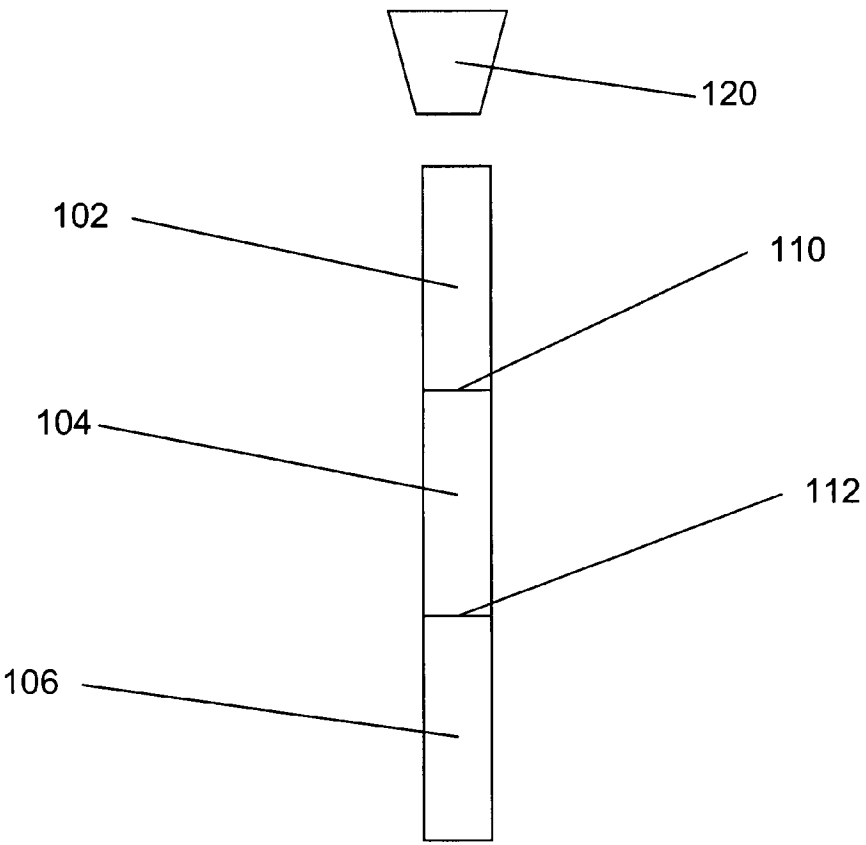
FIG. 1 is a cross-sectional view of expandable pipe sections and a mandrel.

The invention will now be further described with reference to FIG. 1. FIG. 1 illustrates first expandable pipe section 102, second expandable pipe section 104, and third expandable pipe section 106. Weld 110 connects first expandable pipe section 102 to second expandable pipe section 104, and weld 112 connects second expandable pipe section 104 to third expandable pipe section 106.

Mandrel 120 is provided to expand pipe sections 102, 104, and 106, by pushing and/or pulling mandrel through the interior of the pipe sections. In another embodiment, mandrel 120 may be provided with rollers on its exterior surface, which can then be rotated as mandrel 120 is pushed and/or pulled through the interior of the pipe sections.

Figure 2:
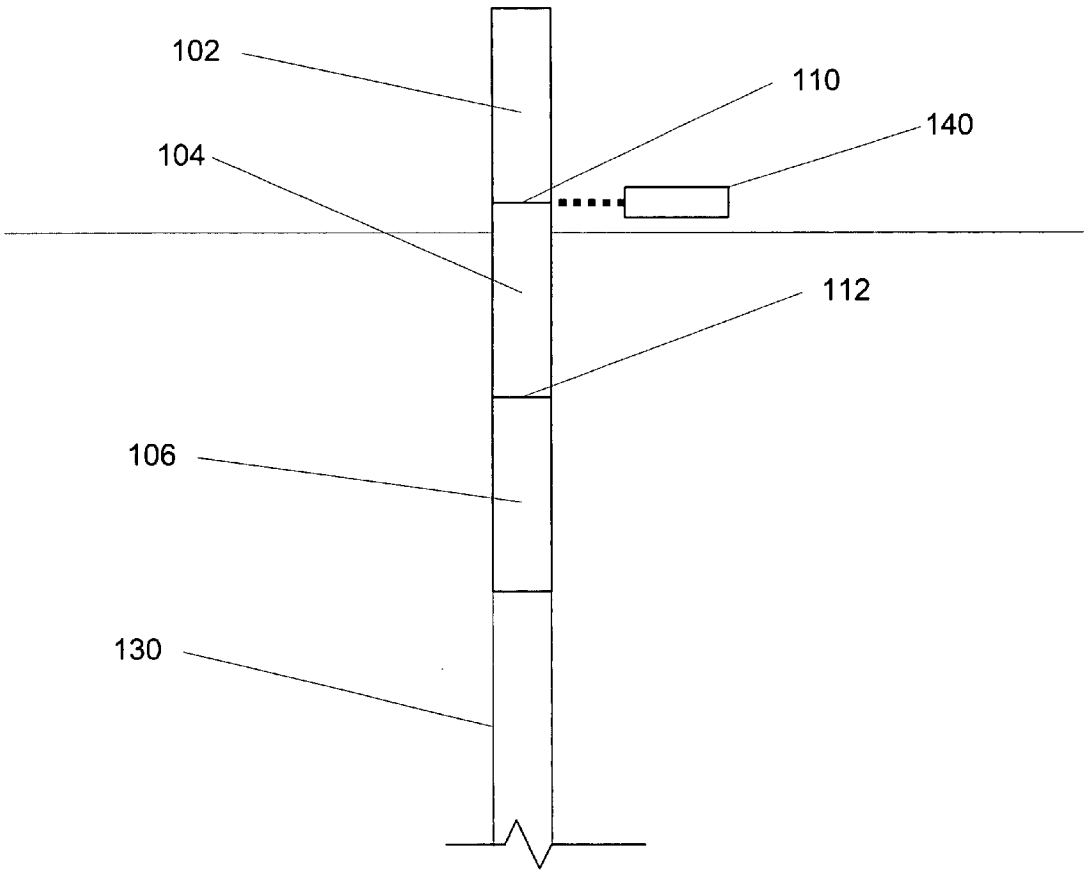
FIG. 2 is a cross-sectional view of expandable pipe sections being lowered into a borehole and welded by a laser.

FIG. 2 illustrates first expandable pipe section 102, second expandable pipe section 104, and third expandable pipe section 106 partially lowered into borehole 130. After sections 106 and 104 were lowered into borehole 130, section 102 was aligned with section 104, and are now being welded together with laser 140. In one embodiment, laser 140 is stationary and sections are rotated to effect the welding. In another embodiment, sections 106 and 104 are stationary, and laser 140 is rotated about sections 106 and 104.

Figure 3:
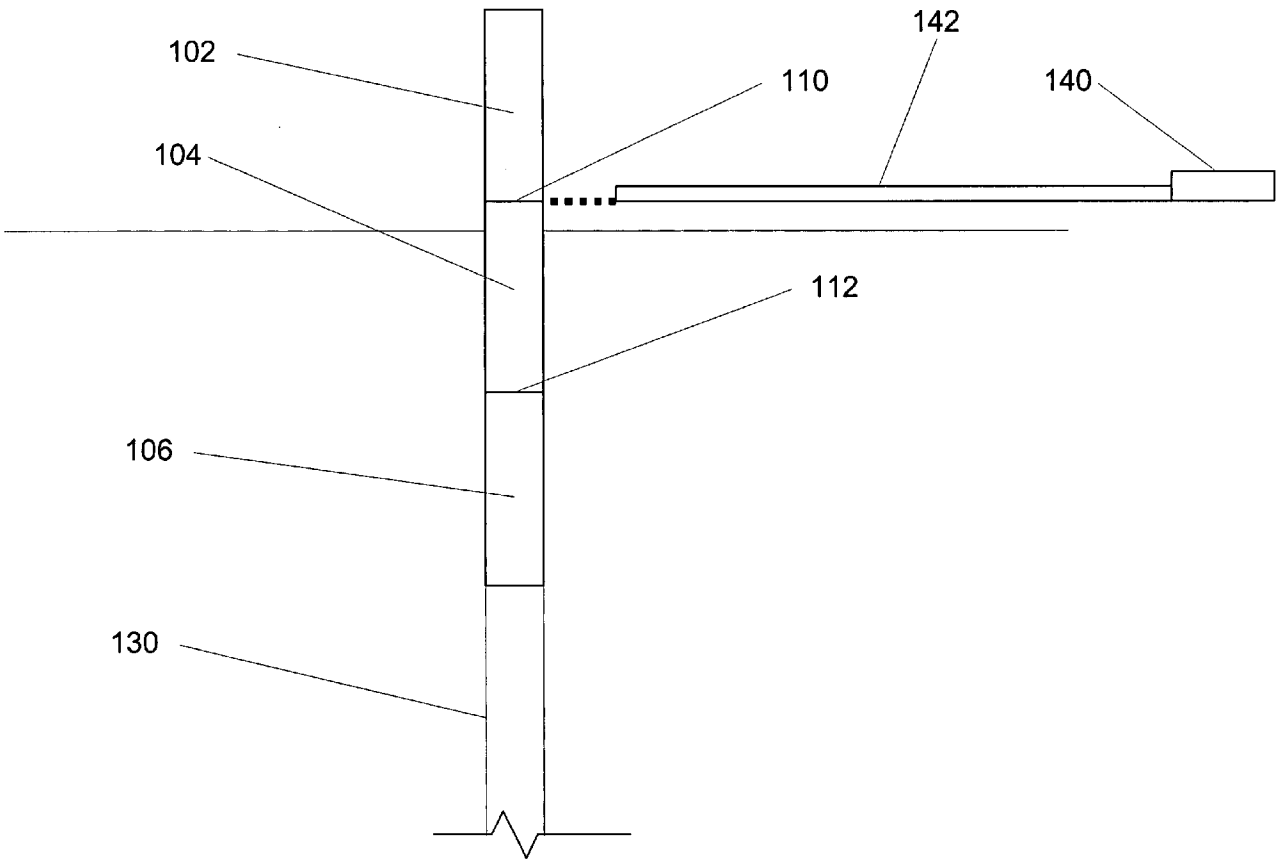
FIG. 3 is a cross-sectional view of expandable pipe sections being lowered into a borehole and welded by a laser.

FIG. 3 illustrates first expandable pipe section 102, second expandable pipe section 104, and third expandable pipe section 106 partially lowered into borehole 130. After sections 106 and 104 were lowered into borehole 130, section 102 was aligned with section 104, and are now being welded together with laser 140 and fiber optical cord 142. In one embodiment, fiber optical cord 142 is stationary and sections are rotated to effect the welding. In another embodiment, sections 106 and 104 are stationary, and fiber optical cord 142 is rotated about sections 106 and 104.

Figure 4:
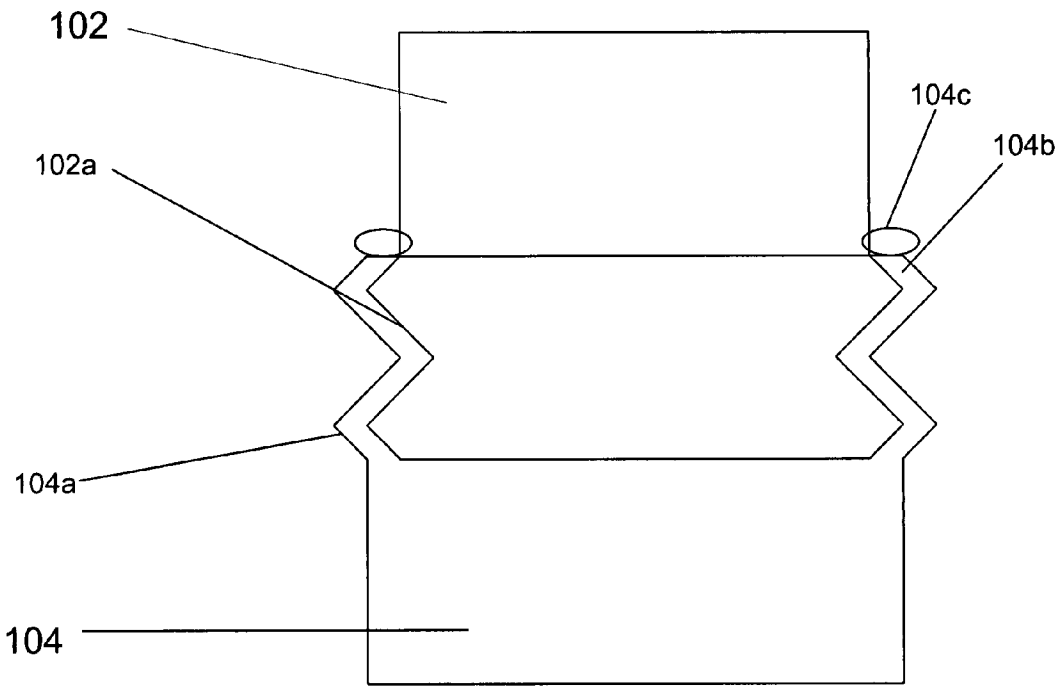
FIG. 4 is a cross-sectional view of threaded expandable pipe sections.

In another embodiment, FIG. 4 illustrates first expandable pipe section 102 having male threads 102*a* connected to second expandable pipe section 104 having female threads 104*a*. Ring-shaped gap 104*b* is defined as the space between male threads 102*a* and female threads 104*a*. Weld bead 10*c* is provided to seal ring-shaped gap 104*b*.

Welding in the form of electrical resistance welding (ERW), submerged arc welding (SAW) and laser beam welding (LBW) are known. For instance, SAW is applied to produce axial welds in expandable pipes prepared from sheets. However, SAW results in "fusion" welds having a relatively large heat affected zone (HAZ). As a consequence, circumferential welds may be susceptible to cracking during expansion.

Laser Beam Welding (LBW) is a known fusion joining process that produces coalescence of materials with the heat obtained from a concentrated beam of coherent, monochromatic light impinging on the joint to be welded. In an LBW process, the laser beam is directed by flat optical elements, such as mirrors, and then focused to a small spot at the joint using either reflective focusing elements or lenses. LBW is a non-contact process, and thus requires no applied pressure.

A detailed review on LBW is given in Chapter 22 of Volume 2 of the Welding Handbook, $8^{th}$ ed. (American Welding Society and AWS, 1992) the contents of which are incorporated by reference.

It has previously not been recognized that LBW is particularly suitable for circumferential welding of expandable pipes. Indeed, it has been found that the material and properties of LBW joints are much alike to that of the surrounding pipe material. The presence of LBW joints will therefore have no noticeable effect on the expansion behaviour of the pipe.

A further considerable advantage of LBW is that the laser heat spot will be small enough to allow safe welding of tubular elements near the borehole. In addition, the laser energy may be transmitted through a fibre optic cable, thus separating the (bulky) laser source from the actual welding station.

Ideally an Nd:YAG laser is applied, since this laser transmits its energy through a fibre optic cable currently at distances up to 200 meters from the laser source. In other words, welding may be safely conducted on the rig floor, where other welding techniques (open flame; electrical resistance, or submerged arc welding) are too hazardous to be used.

In comparison to arc welding (e.g., Tungsten Inert Gas, or TIG), the heat input from this type of laser is generally about 20 to 30%, with a corresponding reduction in the heat affected zone width (=steel material affected by the welding).

For instance, Nd:YAG lasers having a maximum output power of 4 kW may be used in case a weld penetration capacity of about 10 mm is required. When using Nd:YAG lasers with a maximum output power of up to 8–10 kW a weld penetration capacity up to about 20 mm can be achieved. Alternatively, a $CO_2$ laser may be used, which has power levels of more than 10 kW.

The pipes are preferably interconnected in a "square butt weld" joint configuration. The ideal weld profile comprises a full penetration weld with no protrusion of underbead. Less smooth joints, e.g., having a slight underbead or slight lack of full penetration and no underbead will, however, also be acceptable.

For good joint welds the pipes have preferably clean square edges, whereas welding should be undertaken on unoiled surfaces and without thick oxide layers on the surface or edge. Besides, the presence of water, grease and other contaminations should be avoided in view of their effect on the porosity of the joint.

Preferably, the joint welds are subjected to post weld stress relief to improve weld material toughness and consistence of toughness throughout the weld.

The pipes used in the present invention are preferably of a malleable metal such that the outer pipe diameter after expansion is at least 10%, preferably at least 20% larger than the outer diameter of the expandable pipe before expansion. Various metals, and steels in particular, may be used. The selection of the malleable metal is not critical to the present invention. For instance, a non-limitative selection of suitable metals include carbon steel or interstitial-free steel (i.e., low alloy steels) or stainless steels (high alloy steels). Examples of the latter metals include austenitic stainless steel, such as TP 304 L and TP 316 L; duplex stainless steel, containing e.g. 22% CR grade steels; and martensitic steels, e.g. having an about 13% Cr grade steel.

There are no particular requirements as to the length of the pipes. The method of the present invention may tolerate slight deviations in wall thickness, diameter and ovalities of the pipes, so long as joint gaps no greater than 1~2 mm occur, preferably no greater than 0.5 mm occur. Short pipes of API range 1 or 2 (4.9–7.6 m long, respectively 7.6–10.4 m long) may readily be produced meeting these standards. They are therefore particularly suitable for use in the method of the present invention.

Various methods for expanding the joined expandable-pipes of the present invention may be used. For instance, an expansion mandrel or pig may be used as is described in detail in the International applications referred to herein before. Moreover, in International application WO 93/25799 a hydraulic expansion tool is described that is lowered in an unexpanded state into lower section of the pipe. This tool is expanded by operating a connected surface pumping facility. This application also describes an alternative expander that is pushed downward through the pipe. In International application WO 98/00626 an expansion mandrel is presented, that has a non-metallic tapering outer surface that may be pumped through the pipe by means of exerting a hydraulic pressure behind the mandrel.

The invention also provides a preferred method for interconnecting adjacent expandable pipes, the method comprising the steps of:

a) lowering an expandable pipe into a well until the upper end thereof is located near the entrance of the well,
b) aligning and fixing a second expandable pipe in axial direction with the first pipe,
c) interconnecting the first pipe and second pipe by circumferential LBW welding,
d) lowering the interconnected pipes into the well, and
e) expanding the interconnected pipes with expanded-tube technology.

Finally, the invention also relates to a method for drilling and completing a hydrocarbon production well comprising the steps of:

A) drilling a section of a borehole into an underground formation,
B) inserting a sufficient number of interconnected pipes to reach the vicinity of a hydrocarbon bearing formation and expanding the interconnected pipes, wherein the interconnected pipes are interconnected by the process of the invention.

The invention will now be further described on the basis of the following experiments.

Experiment 1

Casings of two different materials, API J-55 and L-80 material, and three different sizes, nominal outside diameter of 5 inch, 5.5 inch 4.5 inch, were laser welded using an Nd:YAG laser. J-55 is a material having a min. yield strength of 55.000 psi; a max. yield strength of 80.000 psi; and a min. tensile strength of 75.000 psi. L-80 is a material having a min. yield strength of 80.000 psi; a max. yield strength of 95.000 psi; and a min. tensile strength of 95.000 psi. The laser welds of these products were evaluated and found to produce gas-tight connections. In these experiments the welds were found to have the toughness of the base material in both the longitudinal and transverse orientation. Toughness was even improved (resulting in a better and more consistent weld) when the welds were subjected to post weld stress relief.

We claim:

1. A method for interconnecting adjacent expandable pipes, wherein the pipes are circumferentially welded together by laser beam welding; wherein the laser beam welding further comprises using a tool which is transformed into a downhole laser beam cutting tool to cut off a partially expanded pipe string below an expansion mandrel or roller that is stuck downhole, and which laser beam cutting tool passes through an orifice in the expansion mandrel or roller.

2. The method of claim 1, wherein an Nd:YAG laser or $CO_2$ laser is used.

3. The method of claim 1, wherein the pipes are interconnected in a welding station on a rig near the bore hole.

4. The method of claim 3, wherein the laser energy is transmitted through a fibre optical cord from a laser source that is up to 200 meters removed from the welding station.

5. The expandable pipe strings prepared in accordance with the method of claim 1.

6. The expandable pipe strings of claim 5, that are made of a malleable steel, selected from the group consisting of carbon steel, duplex stainless steel and martensitic stainless steel, including 13 Cr and super 13 Cr oilfield grades.

7. A method for preparing expanded pipes wherein an expandable pipe as claimed in claim 5 is expanded.

8. The method of claim 7, wherein the expandable pipe is expanded by moving a mandrel and/or a roller through the pipe.

9. The method of claim 7, for the production of a casing, a production tubing or protective cladding in wellbore operations.

10. The method of claim 9, comprising the steps of: lowering an expandable pipe into a well until the upper end thereof is located near the entrance of the well:

a) aligning and fixing a second expandable pipe in axial direction with the first pipe;
b) interconnecting the first pipe and second pipe by circumferential laser beam welding;
c) lowering the interconnected pipes into the well; and
d) expanding the interconnected pipes with a mandrel and/or a roller.

11. The method of claim 1, wherein the interconnected ends of the expandable pipes are equipped with complementary screw threads and are screwed together such that ring-shaped gaps are formed adjacent to the interconnected ends of the expandable pipes, and wherein at least one ring-shaped gap at the outer or inner surface of the interconnected ends of the expandable pipes is circumferentially welded by laser beam welding.

12. The method of claim 1, wherein the laser beam welding comprises a tool which is transformed into a laser beam cutting tool in case a weld made by laser beam welding is rejected.

13. The method of claim 1, wherein the laser beam welding comprises a tool which is transformed into a downhole laser beam welding tool to weld a leaking expanded pipe connection and/or other well component downhole.

14. The method of claim 1, wherein the laser beam welding comprises a tool which is equipped with an optical tracking system for guiding the laser beam at a predetermined distance relative to the pipe ends during the laser beam welding process. relative to the pipe ends during the LBW process.

* * * * *